United States Patent [19]

Lisiecki

[11] 4,394,954

[45] Jul. 26, 1983

[54] CONTAINER AND BLANK FOR CONSTRUCTING SAME

[75] Inventor: Robert E. Lisiecki, Orchard Lake, Mich.

[73] Assignee: Ex-Cell-O Corporation, Troy, Mich.

[21] Appl. No.: 280,739

[22] Filed: Jul. 6, 1981

[51] Int. Cl.[3] ..... G65D 5/74

[52] U.S. Cl. ..... 229/17 G; 229/DIG. 4

[58] Field of Search ..... 229/7 R, 17 R, 17 G, 229/DIG. 4

[56] References Cited

U.S. PATENT DOCUMENTS

| | | | |
|---|---|---|---|
| 3,327,920 | 6/1967 | Hyner | 229/17 G |
| 3,957,180 | 5/1976 | Skillman | 229/7 R |
| 4,093,115 | 6/1978 | Bachner | 229/17 G |
| 4,281,787 | 8/1981 | Hensey | 229/17 G |

*Primary Examiner*—Herbert F. Ross

*Attorney, Agent, or Firm*—John P. Moran

[57] ABSTRACT

A container and a blank therefor, wherein the container is adaptable to being folded into a "flat top" configuration. The blank and container include four body panels; bottom end closure panels; and top end closure panels including a pair of rectangular outer roof panels, and rectangular spout and closure panels. Each of the spout and closure panels includes a gable panel defined in part by diagonal score lines extending toward each other from the horizontal score line between respective body and gable panels, a pair of fold back panels on opposite sides of each gable panel, and a pair of infold lips separated from each other by a central vertical score line and separated from the respective fold back panels by horizontal score lines, one of which is lower than the other. These horizontal score lines meet the respective diagonal score lines at the upper ends thereof at spaced points along the vertical score line. The score line portion between the spaced points serves as a short vertical side at the top of each gable panel. Additionally, horizontal score lines are formed on the outer roof panels aligned with the respective adjacent horizontal score lines formed between the fold back panels and the infold lips, enhancing the foldability of a vertical gable top into a flat top arrangement.

7 Claims, 8 Drawing Figures

CONTAINER AND BLANK FOR CONSTRUCTING SAME

TECHNICAL FIELD

The invention relates generally to a coated paperboard container and, more particularly, to a blank for constructing the container so as to include a folded top end closure of an improved construction.

BACKGROUND ART

Containers for beverages such as milk, cream, other dairy products, juices, and the like are conventionally constructed from thermoplastic coated paperboard. One type of these containers includes a top end closure with a folded gable roof having a vertically projecting seal at the roof ridge for sealing the container and providing a pouring spout when the contents of the container are to be dispensed. Stacking of such containers requires the use of separating trays intermediate different layers due to the vertically projecting seals of their top end closures. Hence, storage space is lost in stacking these containers due to the empty space resulting from the configuration of the top end closure. Such containers are shown by U.S. Pat. Nos. 3,116,002 and 3,270,940. Another type of container includes flat top end closures that are folded and have a flat seal projecting from a centerline of the closure with an outer end that is releasably secured to the rest of the closure generally adjacent one of its sides. Various releasable securements are provided for releasing the flat seals to permit them to be opened and to thereby provide a pouring spout for dispensing the beverages. U.S. Pat. Nos. 3,869,078 and 3,892,347 disclose such flat top end closures. A further type of container is disclosed by U.S. Pat. No. 4,078,715, issued Mar. 14, 1978, and includes a top end closure with an inclined seal that includes a "harder crease" on one side of the seal for facilitating folding of the seal from a vertical position to the inclined position.

U.S. Pat. Nos. 4,012,997 and 4,093,115 disclose a container folding method and the container made by the method wherein certain roof panels of the top end closure are provided with double score lines extending alongside each other. Folding of a top seal of the end closure from a vertical position to a flat position requires the application of a downward force along the lower double score line on one side of the top seal and the application of another force to bend the top seal downwardly. Each additional application of force for folding the top end closure requires an additional folding tool on the folding mechanism.

U.S. Pat. No. 4,206,867 discloses a blank suitable for the formation therefrom of a gable, slant or flat top container. The blank includes wide, lowered score lines formed on the side of the container toward which the top seal is slanted; the front and back gables are triangular in shape and the apices thereof are not geometrically centered.

It is desirable to provide a multi-use container and blank for constructing same, wherein the front and back gable arrangements are geometrically correct constructions, thereby enhancing the probability of being accurately sealed regardless of how the top closure score lines are broken during the forming process on various models of forming, filling and sealing machines. It is further desirable to provide such blanks which lend themselves to substantially perfect nesting of adjacent top closure arrangements across conventional paperboard rolls, to thereby eliminate scrap therebetween and, thus effectuate substantial paperboard savings.

DISCLOSURE OF THE INVENTION

A general object of the invention is to provide an improved coated paperboard container and a blank for constructing the container to include a top end closure comprised of a folded roof and a top seal for sealing the roof, and wherein the construction of the top end closure not only enhances foldability of the top seal from a vertical position to either a slant top or a flat top configuration but also facilitates nesting of adjacent top closure portions, resulting in a narrower roll of paperboard being required.

Another object of the invention is to provide a blank from which the container is constructed, wherein the blank includes a pair of gable panels whose opposite sides are connected to a pair of fold back panels that are of a different size than each other by virtue of the respective upper score line edges thereof intersecting the sides of the intermediate gable panel at different elevations. After sealing by heat or high frequency vibration bonding, folding of the top seal is facilitated in a direction toward the smaller fold back panels so as to enable the top closure to be constructed into a slant top closure or a flat top closure. The closure can also be constructed as a conventional appearing straight-up closure without any folding of the top seal, if desired.

A further object of the invention is to provide a blank for constructing a container top closure arrangement in accordance with the present invention which includes a score line across one outer roof panel between upper and lower closure panels formed a predetermined amount lower than the other score line across the other outer roof panel. The score lines between the infold lips and the associated pair of fold back panels are formed as substantially equal length continuations of the score lines between the upper and lower closure panels. The diagonal score line edges of the front and back gable panels terminate at the spaced-apart inner ends of such equal length score lines, resulting in a short vertical score line edge at the top center of the gable panels. Each of the score line portions between the resultant smaller fold back panels and their associated infold lips, and the score line between the one upper closure panel and its associated lower closure panel, being lower than and substantially equal in length to the respective other score lines of the top end closure, accommodates the formation of a centrally oriented, geometrically correct gable top configuration, while serving to facilitate folding of the top seal from the vertical position to either an inclined position for providing a slant top, or a horizontal position where the top seal may be adhesively bonded to the adjacent outer roof panel to provide a flat top end closure.

Other objects and advantages of the invention will become more apparent when reference is made to the following description and accompanying drawings.

BEST MODE OF CARRYING OUT THE INVENTION

Figure 1:
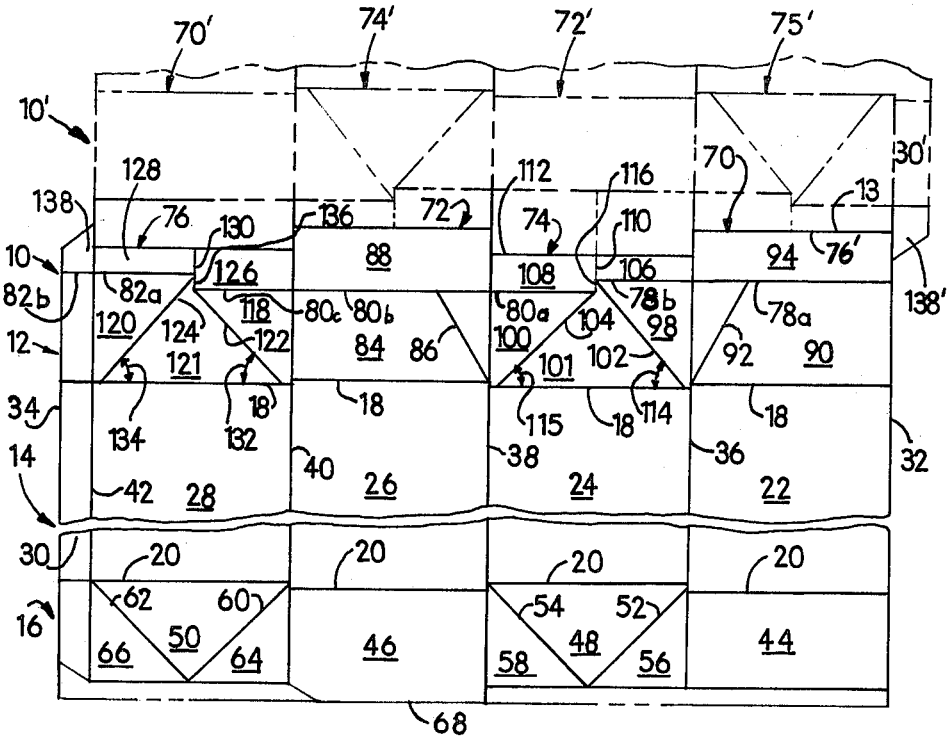
FIG. 1 is a layout view of the inside surface of a coated paperboard container blank from which the top closure of the invention is formed along with illustrating the inter-nested position of an adjacent blank in phantom prior to being cut from a paperboard roll.

Referring now to the drawings in greater detail, FIG. 1 illustrates a container blank 10 formed in accordance with the principles of the present invention. The container blank 10 is generally divided into three sections including a top end closure 12, a body portion 14, and a bottom end closure 16. A staggered lower top horizontal score line 18 extends transversely across the container blank 10 and separates the top end closure 12 and the body portion 14. A bottom staggered horizontal score line 20 extends transversely across the container blank 10 and separates the bottom end closure 16 and the body portion 14. The body portion 14 comprises a plurality of integrally connected body panels 22, 24, 26 and 28, and a side seam flap 30. The container blank 10 is defined on its longitudinal sides by its edges 32 and 34. The body panels 22, 24, 26 and 28, and the side seam flap 30, are defined by vertical score lines 36, 38, 40 and 42, and serve as side, front, side and back panels, respectively, of the formed and sealed container.

The bottom end closure 16 has a pair of external closure panels 44 and 46 which are integral with and extend longitudinally from the body panels 22 and 26, respectively. A pair of substantially triangular closure panels 48 and 50 are an integral part of the flat bottom end closure 16, and they extend longitudinally from the body panels 24 and 28, respectively. The closure panel 48 is defined by the transverse score line 20 and bottom diagonal score lines 52 and 54, and is integrally connected to the external closure panels 44 and 46 by a pair of substantially triangular fold back panels 56 and 58, respectively. The closure panel 50 is defined by the horizontal score line 20 and a pair of bottom diagonal score lines 60 and 62. A pair of substantially triangular fold back panels 64 and 66 integrally connect the closure panel 50 to the external closure panel 46 and the side seam flap 30, respectively. As is set forth in more detail hereinafter, the side seam flap 30 is connected to the external closure panel 44 so as to place the fold back panel 66 adjacent to the external closure panel 44 in a constructed or erected container. As shown in FIG. 1, the external closure panel 44 is not provided with any tuck-in flap, but the external closure panel 46 is provided with an integral overlap flap 68. The details of the bottom end closure 16 are discussed in detail in U.S. Pat. No. 3,498,524 which issued on Mar. 3, 1970, and U.S. Pat. No. 3,120,335 which issued on Feb. 4, 1964, and these patents are incorporated herein by reference.

The top end closure 12 comprises outer roof panels 70 and 72 which are rectangular in shape. The panels 70 and 72 are connected integrally to the upper ends of the body panel members 22 and 26, respectively. A front or spout panel 74 and a back or closure panel 76, both being rectangular in shape, are connected integrally to the body panels 24 and 28, respectively. A staggered upper top horizontal score line, consisting of score line portions 78*a*, 78*b*, 80*a*, 80*b*, 80*c*, 82*a* and 82*b*, extends transversely from the blank edge 32 to the blank edge 34, substantially parallel to the horizontal score lines 18 and 20. As will be explained in greater detail later, the score line portions 80*a*, 80*b* and 80*c* are lower than the other score line portions.

The outer roof panel 72 is divided basically into two rectangular panels by the horizontal score line 80*b*. A lower closure panel 84 is defined by the score lines 40, 38, 80*b* and 18. An opening assist score line 86 extends substantially from the intersection of the score line 18 and the score line 38 to a point on the score line 80*b*. An upper closure panel 88 of the outer roof panel 72 serves as a sealing panel, as will be explained.

The outer roof panel 70 is divided into two rectangular panels by score line 78*a*, one of which is a lower closure panel 90 which is defined by the horizontal score lines 78*a* and 18, the vertical score line 36 and the edge 32. An opening assist score line 92 extends substantially from the intersection of score lines 18 and 36 to a point on the score line 78*a*. The outer roof panel 70 also includes an upper closure panel 94 which is integral with the closure panel 90, and it is separated therefrom by the score line 78*a*. The closure panel 94 likewise serves as a sealing panel.

The spout panel 74 includes a pair of fold back panels 98 and 100 connected on opposite sides of a gable panel 101 by diagonal score lines 102 and 104, respectively, the latter extending from the horizontal score line 18 a predetermined distance from the vertical score lines 36 and 38, respectively. The predetermined distance compensates for the thickness of the paperboard and seves to minimize bulging when the top closure is formed. The fold back panels 98 and 100 are also connected to the closure panels 90 and 84, respectively, via the respective score lines 36 and 38. A pair of pouring panels or infold lips 106 and 108 are integrally connected to the fold back panels 98 and 100, respectively, and they are defined by the horizontal score lines 78*b* and 80*a*, respectively, the vertical score lines 36 and 38, and a vertical gable score line 110. As shown in FIG. 1, the upper outer edge of the spout panel 74 is formed as a straight horizontal edge 112. The numerals 114 and 115 designate the triangular base angles formed between the diagonal score lines 102 and 104, respectively, and the horizontal score line 18. The base angles 114 and 115 are formed so as to be unequal as a result of the vertical score line 110 being centrally located between the score lines 36 and 38, and the diagonal score lines 102 and 104, intersecting the score line 110 at the respective junctures thereof with the horizontal score lines 78*b* and 80*a*, respectively. The result is a short vertical score line 116 for the gable panel 101, extending between ends of the diagonal score lines 102 and 104.

The closure panel 76 includes a pair of fold back panels 118 and 120 connected on opposite sides of a gable panel 121 by diagonal score lines 122 and 124, respectively, the latter extending from the horizontal score line 18 a predetermined distance from the vertical score lines 40 and 42, respectively. The predetermined distance compensates for the thickness of the paperboard and serves to minimize bulging when the top closure is formed. The fold back panel 118 connects the gable panel 121 to the closure panel 84 via the score line 40, while the panel 120 connects the panel 121 to the side seam flap 30. A pair of closure panels or infold lips 126 and 128 are connected to the fold back panels 118 and 120, respectively, and they are defined at their lower ends by the score lines 80*c* and 82*a*, respectively, and at their outer edges by the score lines 40 and 42. The closure panels 126 and 128 are separated from each other by a vertical gable score line 130 which is centrally located between.

The base angles formed by the lower ends of the diagonal score lines 122 and 124 and the horizontal score line 18 are indicated by the numerals 132 and 134, respectively, and in the illustrated embodiment of FIG. 1, these angles are unequal to each other, similar to the base angles 114 and 115. The diagonal score lines 122 and 124 intersect the vertical score line 130 at different points therealong, i.e., at the junctures with score lines 80*c* and 82*a*, resulting in a short vertical score line 136 for the gable panel 121, extending between the spaced apart upper ends of the diagonal score lines 122 and 124.

As illustrated in FIG. 1, the score line portions 80*a*, 80*b* and 80*c*, extending between the diagonal score lines 104 and 122, are formed a predetermined distance below the adjacent score line portions 78*b* and 81*a*. As such, the adjacent fold back panels 100 and 118 are smaller than the respective fold back panels 98 and 120. This difference in size, in conjunction with the effect of the unequal base angles, enhances the foldability of the top end closure. Depending upon paperboard thickness, it has been determined that score line portions 80*a* and 80*c* and/or 78*b* and 82*a* may better facilitate folding if such respective pairs of score lines are sloped slightly downwardly or upwardly to terminate at different points along the short vertical score lines 116 and 136.

It's apparent in FIG. 1 that the adjacent row of blanks 10' nest perfectly with the blanks 10, resulting in no scrap therebetween when the respective blanks are cut from a roll of paperboard. If desired for sealing characteristics, the upper end portions 138 and 138' of the side seam flaps 30 and 30' may be formed horizontally as extensions of the respective edges of the closure panels 76 and 76'.

Figure 2:
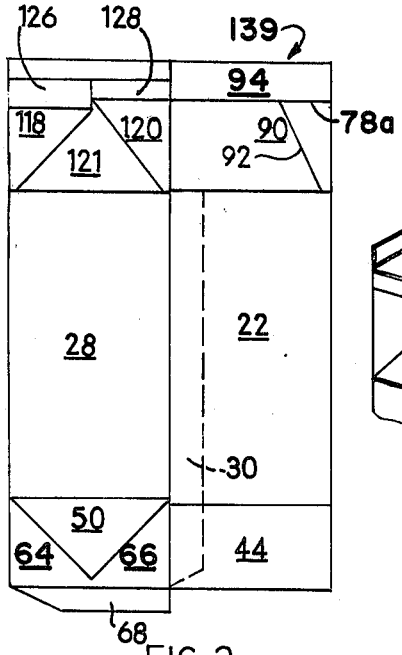
FIG. 2 is a layout view of the outside surface of a container structure after it is side seamed from the container blank illustrated in FIG. 1.
Figure 3:
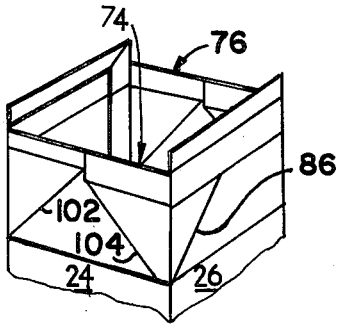
FIG. 3 is a fragmentary perspective view showing the side seamed top container blank illustrated in FIG. 2 in an open ended top end view prior to the closing of the flat top end closure structure of the present invention.

The container blank 10 illustrated in FIG. 1 is formed into a side seamed blank as illustrated in FIG. 2, and as designated by the numeral 139. The side seamed blank 139 is formed by rotating the body panel 28 and the side seam flap 30 as a unit about the vertical score line 40, and having the inside surfaces of the body panel 28 come into contact with the inside surface of the body panel 26, with the vertical score line 42 positioned next to the vertical score line 38, and with the inside surface of the side seam flap 30 contacting the inside surface of the body panel 24 adjacent the vertical score line 38. The body panel 22 is then rotated about the vertical score line 36 to bring its inside surface into contact with the inside surface of the body panel 24. The inside surface of the body panel 22 along the edge 32 comes into contact with the outside surface of the side seam flap 30, and the edge 32 is positioned parallel and substantially aligned with the vertical score line 42. The various members of the top end closure 12 and the bottom end closure 16 will make similar movements, and the container will appear as illustrated in FIG. 2. The container blank 10 is then adhesively seamed in the location where the inside area of the body panel 22 comes into contact with the outside surface of the side seam flap 30.

In the next step in forming the side seamed blank 139 into a container the side seamed blank 139 is opened up into a squared condition, after which the flat bottom end closure 16 is formed in a manner well known in the container art, and disclosed in detail in the above cited prior art patents. Generally, in the forming of the flat bottom end closure 16, the closure panels 48 and 50 are moved about the horizontal score line 20 toward the middle of the container. The fold back panels 56/58 and 64/66 rotate about the diagonal score lines 52/54 and 60/62, respectively, with their outside surfaces contacting the outside surfaces of the closure panels 48 and 50. At the same time, the external closure panels 44 and 46 are moving towards each other. The various portions of the flat bottom end closure 16 are then sealed, either by heat or high frequency vibration techniques, to form a liquid tight flat bottom end closure structure.

After the bottom end closure 16 is formed, as described above, and a product has been inserted in the container, the various parts of the top end closure 12 are folded about the various score lines in the following manner so as to form the top end structure 12. The spout panel 74 is moved around the horizontal score line 18 over the end of the filled container and towards its center. At the same time, the closure panel 76 is moved toward the middle of the filled container about the horizontal score line 18.

The outside surfaces of the pouring panels or infold lips 106 and 108 will be rotated towards each other about the vertical score line 110, and the closure panels or infold lips 126 and 128 will likewise have their outside surfaces rotated towards each other about the vertical score line 130. The inside surfaces of the infold lips 108 and 126 will come into contact with the sealing panel 88. The inside surface of the infold lips 106 and 128 will come into contact with the sealing panel 94 and the associated portion 138 of the side seam flap 30.

Figure 4:
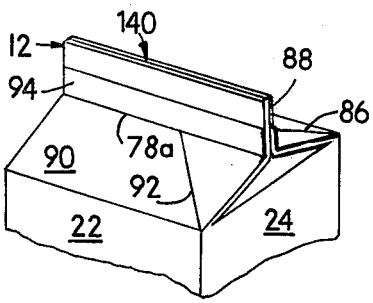
FIG. 4 is a fragmentary perspective view showing the top container blank of FIG. 3 rotated 90°, with the cooperating panels in vertical position to permit sealing of the container top end closure structure to provide a liquid proof seal for the container.

As viewed in FIG. 4, the last mentioned top closure elements form a gable top over the body portion 14. The sealing of the last mentioned elements of the top closure 12 is preferably accomplished by a sonic or high frequency vibration sealing means, because such a seal gives a liquid tight seal, and yet is easily opened. The sealing of these various top end closure elements may also be accomplished by other means, such as heated air, if desired. As a result of the sealing process, and the central location of the vertical score lines 110 and 130, the sealing panels 94 and 88 are disposed in a position perpendicular to a plane perpendicular to the body panels 22, 24, 26 and 28 to form a top seal 140, with closure panels being aligned with each other. The filled container can be utilized in this manner, if desired, comparable to a conventional straight up vertical gable top container, but with a shorter gable height relative thereto.

Figure 5:
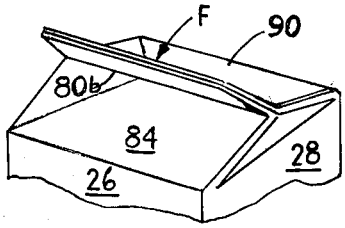
FIG. 5 is a fragmentary perspective view showing the container of FIG. 4 turned around and after the top seal has been bent from the vertical position of FIG. 4 to the inclined position shown in order to provide a slant top container.

Alternately, the top seal 140 may be moved to an inclined position by the application of a force F, as shown in FIG. 5, in order to provide a, so-called, slant top container. As indicated above, folding of the top seal 140 to the slant top position shown in FIG. 5 is facilitated by the lower score lines 80*a*, 80*b* and 80*c*, and the smaller fold back panels 100 and 118. The top seal 140 leans toward the smaller fold back panels 100 and 118 and the closure panel 84. A tendency to lean is enhanced by the lowered score lines 80*a*, 80*b* and 80*c*.

Figure 6:
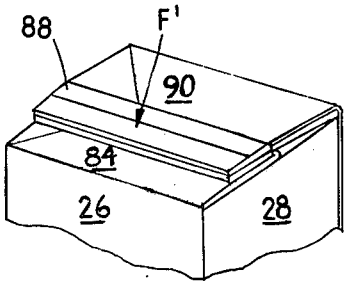
FIG. 6 is a fragmentary perspective view showing the top container blank illustrated in FIGS. 3 and 4 after the top end closure structure has been sealed, and the hold down tab portion thereof has been sealed to the outer surface of the inner roof panel to provide a flat top end liquid proof container.

The versatility of the container blank 10 shown in FIG. 1 is further demonstrated by FIG. 6, wherein the top seal 140 is shown folded over to a horizontal position in order to provide a flap top end closure. The application of force F', by use of a suitable tool, serves to further move the top seal into contact with the side of the container on which the lower score lines 80*a*, 80*b* and 80*c* are located. The upper closure panel 88 is then releasably secured to the lower closure panel 84 by a suitable adhesive bond provided in any conventional manner in order to provide the flat top closure.

Figure 7:
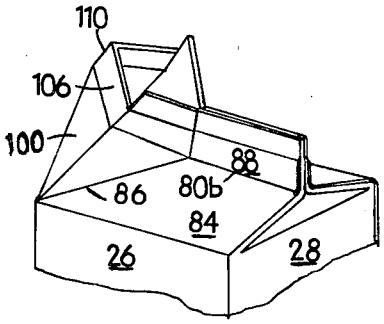
FIG. 7 is a fragmentary perspective view showing the container of FIG. 6, after the seal of FIG. 6 is broken, and with the container in its open position to form a pouring spout.
Figure 8:
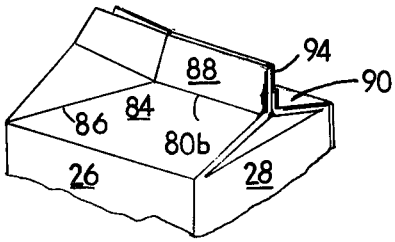
FIG. 8 is a fragmentary perspective view showing the container after the pouring spout has been moved to the closed position to reclose the container.

Opening of the constructed flat top end closure is effected by first releasing the top seal 140 from the lower closure panel 84, and then moving the top seal to either the slant position of FIG. 5 or the vertical position of FIG. 4 followed by opening of the pouring spout in the well known manner, to the position shown in FIG. 7. The front gable panel 101 and its connected fold back panels 98 and 100 cooperate with the opening assist score lines 86 and 92 on the lower closure panels 84 and 90 to provide the pouring spout that is used to dispense the contents of the container. The container may then be reclosed after which the top seal 140 will assume an attitude similar to that shown in FIG. 8.

Industrial Applicability

It should be apparent that slant top containers like the container shown in FIG. 5 can be packed in layers on top of each other to minimize the storage and cargo space necessary. As the containers are stacked, their slant top seals will deflect downwardly. As this deflection takes place, the slant top end closure provides an inherent cushioning effect between the layers of containers to enhance the transportability of the containers without leakage occurring. Unlike folded gable roof closures with vertically projecting seals (FIG. 4), this container does not require any shipping tray intermediate the different layers of stacked containers. These advantages are also apparent with respect to flat top end closures, as shown in FIG. 6.

It should be further apparent that the construction embodying the lower score line arrangement on one side of the top end closure enhances the foldability of the top seal toward the smaller fold back panels into either a slant top or a flat top container. Prior art slant top and flat top containers tend to be slightly distorted as a result of conventional sealing techniques being applied to their particular geometric constructions, whereas the instant invention embodies a geometrically correct construction adaptable to being more readily formed into a multi-use top closure.

While but one embodiment of the invention has been shown and described, other modifications thereof are possible.

The embodiments of the invention in which an exclusive property or privilege is claimed are as follows:

1. A plastic coated paperboard blank for constructing a container adaptable to being folded into a flat end container, the blank comprising; four body panels and a side seam flap; end closure panels respectively connected by horizontal score lines to one of the ends of the body panels; end closure panels including a pair of outer panels consisting of upper and lower closure panels respectively connected by horizontal score lines to the other ends of two of the body panels, a front panel and a back panel respectively connected by horizontal score lines to said other ends of the other two body panels, each including a gable panel defined by diagonal score lines extending toward each other from the horizontal score lines, a pair of fold back panels connected by the diagonal score lines to opposite sides of the respective gable panels, and a pair of infold lips separated from each other by a centrally located vertical score line and separated from the respective fold back panels by substantially horizontal score lines, one of which is lower than the other, and both of which meet the respective diagonal score lines at the upper ends thereof at spaced points along the vertical score line, resulting in a short vertical side at the top of each of the gable panels.

2. The plastic coated paperboard blank described in claim 1, wherein horizontal score lines are formed between the respective upper and lower closure panels and are aligned with the respective horizontal score lines formed between the fold back panels and infold lips.

3. The plastic coated paperboard blank described in claim 1, wherein the lower ends of the diagonal score lines begin on the horizontal score lines between the spout and closure panels and the body panels a predetermined distance away from the opposite edges of the respective body panels.

4. The plastic coated paperboard blank described in claim 1, wherein the resultant base angles of each of the gable panels are different from one another.

5. The plastic coated paperboard blank described in claim 1, wherein the terminal edges of the outer roof panels and the front and back panels are straight, thereby permitting substantially perfect nesting with the top end closure arrangement of an adjacent blank across the width of a roll of paperboard.

6. In a container adaptable to being folded into a "slant top" container or a "flat top" container, and including body panels having front and back panels and a pair of side panels; bottom end closure panels connected by horizontal score lines to lower ends of the respective body panels; top end closure panels including a pair of outer roof panels respectively connected by a first pair of horizontal score lines to the upper ends of the side panels, the outer roof panels each including an upper and a lower closure panel interconnected by a second pair of horizontal score lines, a spout panel and a closure panel respectively connected by a third pair of horizontal score lines to the upper ends of the front and back body panels, each of the spout panel and the closure panel including a gable panel being defined by diagonal score lines extending at different angles with respect to each of the third pair of horizontal score lines toward each other, a pair of fold back panels connected by the diagonal score lines to opposite sides of each of the gable panels, and a pair of infold lips, each pair being connected to each other by a vertical score line and connected to one of the respective pairs of fold back panels by a fourth pair of substantially horizontal score lines; the improvement comprising said vertical score line being located along the center line of said gable panels and intersecting the respective diagonal score lines at the upper ends thereof, resulting in a short vertical side at the top of each of the gable panels connecting the inner ends of the respective fourth pair of horizontal score lines, thereby enhancing the foldability of the formed and sealed top closure arrangement from a gable top configuration to a slant top or to a flat top configuration.

7. The container described in claim 6, wherein the lower ends of the respective sets of diagonal score lines begin on the third pair of horizontal score lines a predetermined distance away from the extensions of the opposite edges of the respective front and back panels.

* * * * *

UNITED STATES PATENT OFFICE

CERTIFICATE OF CORRECTION

Patent No. 4,394,954 Dated July 26, 1983

Inventor(s) Robert E. Lisiecki

It is certified that error appears in the above-identified patent and that said Letters Patent are hereby corrected as shown below:

Claim 3, line 4, substitute "front and back" for "spout and closure".

Claim 5, line 2, delete "roof".

Claim 5, line 5, delete "top".

Signed and Sealed this

*Eighth* Day of *January 1985*

[SEAL]

*Attest:*

*Attesting Officer*

GERALD J. MOSSINGHOFF

*Commissioner of Patents and Trademarks*